United States Patent [19]

Brokmann et al.

[11] 4,047,824

[45] Sept. 13, 1977

[54] HOOK AND CORD CONNECTION

[76] Inventors: Manfred Brokmann, Silcherstr. 5; Kurt Sanders, Friedrichstr. 29; Dieter Sanders, Haneschweg 2; Hermann Westhoff, Augustenburgerstr. 85a, all of Osnabrueck, Germany

[21] Appl. No.: 672,240

[22] Filed: Mar. 31, 1976

[30] Foreign Application Priority Data

Apr. 18, 1975 Germany ..... 2517188

[51] Int. Cl.[2] ..... A47C 23/22

[52] U.S. Cl. ..... 403/209; 403/266; 403/341; 160/404; 24/265 H; 43/44.83

[58] Field of Search ..... 403/209, 213, 212, 266, 403/267, 341; 160/371, 404, DIG. 15, 378; 24/27, 230.5 W, 265 H, 73 HH, 265 C, 143 B; 43/44.83, 44.89, 43.16

[56] References Cited

U.S. PATENT DOCUMENTS

| | | | |
|---|---|---|---|
| 878,719 | 2/1908 | Gardyne | 24/143 H |
| 2,138,702 | 11/1938 | Litsey | 403/213 |
| 3,263,294 | 8/1966 | Pappas | 24/265 C |
| 3,375,861 | 4/1968 | Marlow | 160/404 |

FOREIGN PATENT DOCUMENTS

| | | | |
|---|---|---|---|
| 386,737 | 1/1933 | United Kingdom | 160/378 |
| 1,320,918 | 6/1973 | United Kingdom | 160/371 |

*Primary Examiner*—Andrew V. Kundrat

[57] ABSTRACT

A connection between a metal wire hook and a cord of synthetic fiber material particularly suitable for connecting nets of crossing cords into frames for chairs, sofas, beds and similar furniture. The metal wire has a bent portion with a free end. The bent portion of the metal wire spans an angle in excess of 180° and has a pair of shanks which define a clearance space therebetween. The cord extends through this clearance space and the portion of the cord in the clearance space is squeezed and has therefore a reduced cross-section. The hooked portion of the metal wire and the squeezed portion of the cord are preferably cast into a sheathing of thermoplastic material.

1 Claim, 6 Drawing Figures

HOOK AND CORD CONNECTION

BACKGROUND OF THE INVENTION

The invention relates to a connection of a hook or similar connecting member made out of metal wire which is in engagement with a cord, strand or similar member made out of artificial fibers. A folded over end region of the cord passes through the bent portion of the hook shaft. The invention is particularly adapted to be used with stretched nets in frames of chairs, sofas, beds and the like. In this type of furniture cords which cross over each other at an angle are connected to each other at the crossing points and are connected at their ends by means of connecting hooks.

In a known construction of this type, the end portion of the cord extends through a bent portion of the hook shaft which is formed as a closed eyelet. The end of the cord which is guided through the eyelet is connected with the cord portion extending towards the eyelet by means of wire clamps and forms therewith a closed loop. Such a connection is inexpensive to manufacture but its strength depends entirely on the clamping part of the wire clamp which forms the cord loop. Since such furniture is subjected to dynamically changing loads acting on the cord, its strength, namely the fatigue strength or life of such a connection frequently is insufficient even when two or three wire clamps enclose the cord loop. In addition thereto, the wire clamps corrode with the passage of time which causes a weakening of the connection. This drawback is particularly significant in moist climates where such connections may fail after a relatively short time.

In lieu of the aforedescribed connections, which are primarily used with cords, there are also known a large number of very strong connections for wire ropes, where the connection is made between a wire rope eyelet and a connecting member. Such connections require, however, large labor and material input as well as the utilization of expensive machinery for manufacturing such connections. Therefore, such connections, which may utilize metal wire as a material for the eyelets or wire ropes, are too costly to be used in the manufacture of inexpensive items such as furniture.

SUMMARY OF THE INVENTION

It is a general object of this invention to provide a connection of the aforedescribed type wherein the hook shaft is bent in such a way that the cord which extends through the eyelet is squeezed and has a correspondingly narrowed cross section in the region extending through the eyelet. The bent portion of the hook shaft is U-shaped and has a pair of converging shanks the full bore width of which falls short of the basic cross section of the cord. According to a preferred embodiment of the invention the bent portion of the hook shaft together with the squeezed and bent over end region of the cord are cast into a sheating thermoplastic material.

The connection according to this invention attains suprisingly a tensile or breaking strength which equals the strength of the wire material used for producing the hook or the cord made out of synthetic material while at the same time the manufacture of the connection is extremely simple and inexpensive. Thus, all the requirements for the connection are obtained at very low cost. The sheating of plastic material which covers the connection insulates the connection from deterioration due to atmospheric conditions as well as protects it against mechanical damage which could reduce the strength particularly during long period of use. The molten mass of thermoplastic material penetrates into the region of the connection and impregnates the cord made of synthetic material in the region of the connection which increases the strength of the connection as well as fixes the bent over portion of the cord end. Lastly, the plastic sheathing optically screens the entire region of the connection.

BRIEF DESCRIPTION OF THE DRAWING

The novel features which are considered as characteristic for the invention are set forth in particular in the appended claims. The invention itself, however, both as to its construction and its method of operation, together with additional objects and advantages thereof, will be best understood from the following decription of specific embodiments when read in connection with the accompanying drawings.

DESCRIPTION OF THE PREFERRED EMBODIMENT

Figure 2:
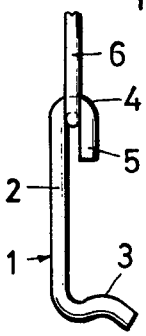
FIG. 2 is a view corresponding to the wire hood and cord of FIG. 1 displaced by 90 degress therefrom along a horizontal plane.
Figure 1:
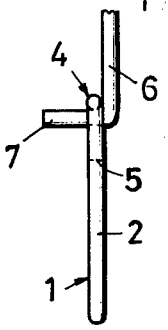
FIG. 1 is a fragmentary schematic illustration of a wire hook together with the cord end to be connected thereto before a squeezing action of the cord has occurred.

FIGS. 1 and 2 illustrate a connecting hook 1, the hook shaft 2 of which has at its end a hook portion 3 which serves for example to hook into the bore of a frame of a chair or bed or other similar piece of furniture. The hook shaft 2 has at its other end a bent portion 4 of U-shape; the shanks 2, 5 forming the U extend temporarily parallel to each other and define between them an intermediate space the narrowest clearance of which corresponds substantially to the unsqueezed cross section of the cord 6 which is to be connected to the hook 1. The cord 6 which is formed out of synthetic filaments or fibers is passed through the bent portion 4 in such a way that its free end 7 extends a small distance beyond the bent portion of the hook shaft 2 as is illustrated in FIG. 1 of the drawing.

Figure 4:
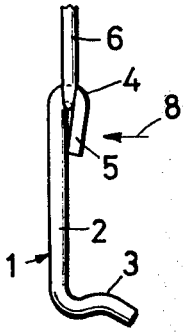
FIG. 4 is a view 90° removed from the view of FIG. 3 along a horizontal plane.
Figure 3:
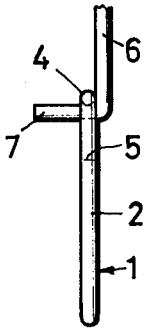
FIG. 3 is a view similar to the view of FIG. 1 after a plastic pressure deformation of the bent portion of the hook shaft has occurred.

The U-shaped bent portion of the hook shaft 2 is pressed together in the direction of the arrow 8 (see FIG. 4) by means not shown so that the bent region 4, 5 of the hook shaft 2 is plastically deformed, that is, is permanently deformed into a hook which squeezes the cord 6, in the region in which it extends through the bent portion 4 of the hook shaft 2, thereby decreasing the cross sectional area of the cord 6 in that region. The hook shaft 2 thus attains in its bent region the shape of a U having converging shanks 2, 5. The clearance width in the bent portion 4 of the hook is thus reduced to such an extent that it becomes smaller than the basic unsqueezed diameter of the cord.

Figure 6:
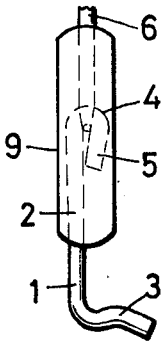
FIG. 6 is a view corresponding to FIG. 5 but 90° removed along a horizontal plane.
Figure 5:
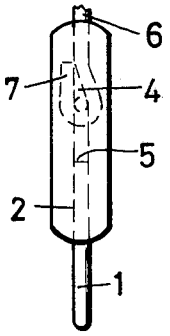
FIG. 5 is a view similar to the views of FIGS. 1 and 3 of the completed connection in accordance with the invention.

Thereafter, the free cord end 7 is folded over as illustrated in FIG. 5. Thereafter, the entire bent portion together with the squeezed cord and folded over cord end 7 is cast into a sheating 9 made out of thermoplastic material, for example a hot melt. This sheating can, for example, be produced by injecting the plastic material into a mold surrounding the bent portion of the hook. The thermoplastic mass of the sheathing 9 fills and penetrates into all hollow spaces in the bent region and surrounds and impregnates the folded over portion of the cord, so that the entire connection is screened and insulated from all ambient conditions. The following plastic materials have been found suitable for the making of the sheating 9: polyethylene, polyvinylchloride, polyamide, polypropylene and polyurethane. The aforementioned hot melt can be a synthetic glue having a polyurethane base. Furthermore, the sheating 9 fixes and secures in place the portion of the cord which is folded over and thereby increases the strength of the connection due to the intimate contact with the cast in place parts of the connection. As is illustrated in FIGS. 5 and 6, the sheathing 9 extends a limited distance beyond the bent portion of the hook shaft 2 and a limited distance beyond the folded over portion of the synthetic cord 6, thereby also carrying out a straightening function between the hook shaft 2 and the cord 6.

Although the invention is illustrated and described with reference to a plurality of preferred embodiments thereof, it is to be expressly understood that it is no way limited to the disclosure of such plurality of preferred embodiments, but is capable of numerous modifications within the scope of the appended claims.

What is claimed is:

1. A connection between a metal wire hook and a cord of synthetic fiber material, comprising a metal wire having a plastically deformed bent U-shaped portion with a free end, said bent portion spanning an angle exceeding 180° and having a pair of converging shanks which define a clearance space therebetween;

a cord having an unsqueezed cross-sectional area, said cord extending through said clearance space with its free end folded over, the portion of said cord being squeezed so that its cross-sectional area is reduced;

said bent portion of said metal wire is U-shaped and said pair of shanks converge, the maximum width of said clearance space in the bent portion being substantially less than the diameter of said unsqueezed cross-sectional area of said cord;

at least said bent portion of said metal wire and said squeezed portion and free end of said cord are cast into a sheathing of thermoplastic material and impregnated thereby.

* * * * *